US007763744B2

(12) United States Patent
Tynik et al.

(10) Patent No.: US 7,763,744 B2
(45) Date of Patent: Jul. 27, 2010

(54) MOLYBDENUM DIALKYLDITHIOCARBAMATE COMPOSITIONS AND LUBRICATING COMPOSITIONS CONTAINING THE SAME

(75) Inventors: Robert J. Tynik, Norwalk, CT (US); Steven G. Donnelly, Bethel, CT (US); Thomas J. Karol, Holuoloa, HI (US)

(73) Assignee: R.T. Vanderbilt Company, Inc., Norwalk, CT (US)

( * ) Notice: Subject to any disclaimer, the term of this patent is extended or adjusted under 35 U.S.C. 154(b) by 1005 days.

(21) Appl. No.: 11/363,896

(22) Filed: Feb. 28, 2006

(65) Prior Publication Data

US 2006/0199745 A1 Sep. 7, 2006

Related U.S. Application Data

(60) Provisional application No. 60/657,610, filed on Mar. 1, 2005.

(51) Int. Cl.
*C07F 11/00* (2006.01)
*C10M 159/18* (2006.01)

(52) U.S. Cl. ..... 556/63; 556/38; 556/50; 508/230; 508/363

(58) Field of Classification Search ..... 508/230, 508/363; 556/50, 63
See application file for complete search history.

(56) References Cited

U.S. PATENT DOCUMENTS 3,356,702 A 12/1967 Farmer et al.
3,509,051 A 4/1970 Farmer et al.
4,098,705 A 7/1978 Sakurai et al. ..... 252/33.6
4,178,258 A 12/1979 Papay et al. ..... 252/32.7 E
4,529,526 A 7/1985 Inoue et al. ..... 252/32.7
(Continued)

FOREIGN PATENT DOCUMENTS

JP 62081396 A 4/1987

OTHER PUBLICATIONS

Tomah Products Technical Data Sheet DA 1618, May 2, 1996, 337 Vincent Street Milton, WI 53563, pp. 1-4.*

*Primary Examiner*—Ellen M McAvoy
*Assistant Examiner*—Vishal Vasisth
(74) *Attorney, Agent, or Firm*—Norris, McLaughlin & Marcus

(57) ABSTRACT

The invention relates to a novel asymmetrical, secondary dialkylamine-based molybdenum dithiocarbamate with improved friction reducing performance, viscosity and solubility, and lubricating compositions containing the same. The compounds are produced from asymmetrical dialkylamine of the formula R1-NH—R2 where R1 and R2 are different, and are independently selected from alkyl groups C3 to C19. In a preferred embodiment, R3 and R4 are different and are independently selected from alkyl groups C3 to C19. The molybdenum dithiocarbamates can be represented by the following formula:

v = 1-2;
w = 1-2;
x + y = 2-5;
z = 1-2

8 Claims, 2 Drawing Sheets

U.S. PATENT DOCUMENTS 4,692,256 A * 9/1987 Umemura et al. ..... 508/362
4,705,766 A 11/1987 Howell et al. ..... 502/167
4,846,983 A 7/1989 Ward, Jr. ..... 252/33.6
5,281,347 A 1/1994 Igarashi et al. ..... 252/42.7
5,356,547 A 10/1994 Arai et al.
5,445,749 A * 8/1995 Hong ..... 508/443
5,494,608 A 2/1996 Kamakura et al. ..... 252/42.7
5,605,880 A 2/1997 Arai et al. ..... 508/379
5,627,146 A 5/1997 Tanaka et al. ..... 508/363
5,696,065 A 12/1997 Tanaka et al.
5,744,430 A 4/1998 Inoue et al. ..... 508/295
5,814,587 A 9/1998 Vrahopoulou et al. ..... 508/363
5,840,672 A 11/1998 Gatto ..... 508/334
5,916,851 A 6/1999 Hosonuma et al.
5,939,364 A 8/1999 Polizzotti et al. ..... 508/363
5,994,277 A 11/1999 Ritchie et al. ..... 508/365
6,074,993 A 6/2000 Waddoups et al. ..... 508/364
6,103,674 A 8/2000 Nalesnik et al. ..... 508/334
6,245,725 B1 6/2001 Tanaka et al. ..... 508/365
6,268,316 B1 7/2001 Tanaka et al. ..... 508/291
6,300,291 B1 10/2001 Hartley et al. ..... 508/363
6,329,328 B1 12/2001 Koganei et al. ..... 508/365
6,444,624 B1 9/2002 Walker et al. ..... 508/363
2003/0224951 A1 12/2003 McConnachie et al.

* cited by examiner

MOLYBDENUM DIALKYLDITHIOCARBAMATE COMPOSITIONS AND LUBRICATING COMPOSITIONS CONTAINING THE SAME

This application is a Continuation of Ser. No. 60/657,610, filed Mar. 1, 2005.

BACKGROUND OF THE INVENTION

1. Field of the Invention

The invention relates to novel asymmetric molybdenum dialkyldithiocarbamates, prepared from asymmetric dialkylamines, which are useful as additives in lubricating compositions.

2. Discussion of the Prior Art

Molybdenum dithiocarbamate are well-known additives for lubrication formulation. Molybdenum dialkyldithiocarbamates prepared from symmetrical dialkylamines and mixtures of symmetrical dialkylamines are currently used as additives in lubricating oils (as well as mixtures thereof) for imparting antifriction properties. While these compositions are quite effective, there is a desire for compounds that will offer improvements or provide even greater lubricating properties. Also, in certain lubricating oil compositions, prior art molybdenum dialkyldithiocarbamates do not have the desired solubility, especially at lower temperatures, so that the compound separates from the lubricating composition, resulting in the formation of a haze, cloud or precipitate in the lubricating composition, thus reducing its effectiveness.

Therefore, there is also a desire for molybdenum dialkyldithiocarbamates with improved solubility in lubricating compositions. In addition, current molybdenum dithiocarbamates (DTCs) require the addition of substantial amounts of diluent oil to lower the viscosity of the additive to acceptable levels for handling. This reduces the activity of the additive by dilution. Therefore, additives that require less diluent oil to afford a readily pourable product are advantageous. Molybdenum dithiocarbamates can be rendered according to the following formula (1):

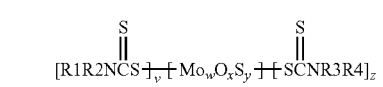

(1)

v = 1-2;
w = 1-2;
x + y = 2-5;
z = 1-2

A particular type of asymmetric molybdenum dithiocarbamate (Mo DTC) is known, in which the R1 and R2 group on one side of the molybdenum groups differ from the R3 and R4 groups on the other side. However, these compounds are believed to be formed by a mixture of two different symmetric dialkylamines, HNR1R2 and HNR3R4, where R1=R2 and R3=R4, and R1 is not the same as R3. For example, U.S. Pat. No. 5,627,146 to Tanaka, et al. describes lubricating oil compositions that contain specifically $C_8$ dithiocarbamyl and $C_{13}$ dithiocarbamyl ligands to produce an asymmetric type molybdenum dithiocarbamate as an essential component thereof.

A further Tanaka patent U.S. Pat. No. 6,245,725 does speak generally of asymmetric Mo DTC compounds wherein R1, R2, R3 and R4 must merely have one dissimilar alkyl to establish asymmetry, and also states generally that compounds may be formed from a secondary amine having different hydrocarbon groups. Furthermore, the patent suggests that asymmetric Mo DTC's should be blended with symmetric Mo DTC's in order to achieve good performance. However, such a compound would have been an impossibility at the time of Tanaka's teaching, since such asymmetric dialkylamines did not exist at that time. Only recently have such amines become available, such as (2-ethylhexyl) tridecylamine from Nova Molecular Technologies, Inc. of Janesville, Wis., USA; and isodecyloxypropyl-isopropylamine and alkoxypropyl-isopropyl (alkyl=C12 to C15), from Tomah Products, Inc. of Milton, Wis., USA.

Accordingly, it is seen that the only working example in the '725 patent is the same C8/C 13 Mo DTC as taught by the Tanaka '146 patent. There is no suggestion that such asymmetric dialkylamines were available at that time, and the patent merely relies on two different secondary amines, one C8 and the other C13. Since it would not have been possible to even formulate such compounds at that time, it could also not have been foreseen that, not only are such compounds (based on asymmetric dialkylamines) possible, but that they surprisingly provide even greater friction performance than either symmetric Mo DTCs or the asymmetric Mo DTC taught by Tanaka which is formed from two different symmetric dialkyl amines.

Equally surprising is the discovery that the novel asymmetric compositions have lower viscosity than the composition taught by Tanaka. As less diluent oil is needed for handling, the result is that a lubricating composition, such as a base oil composition, can comprise a greater amount of molybdenum than can the prior art compounds. Thus, the inventive compositions allow for a lubricating composition having up to 12-15% weight percent molybdenum, compared to only about 7.5% maximum when using a symmetric Mo DTC.

SUMMARY OF THE INVENTION

In order to overcome the shortcomings of the existing molybdenum dithiocarbamate compounds in lubricating compounds, applicants have discovered novel asymmetric Mo DTCs formed from asymmetrical dialkyl secondary amines. Such compounds are formed by dialkyl amines of the general formula HNR1R2, where R1 and R2 are dissimilar. Examples of such amines include (2-ethylhexyl) tridecylamine, isodecyloxypropyl-isopropylamine and alkoxypropyl-isopropyl (alkyl=C12 to C15, i.e. presumably derived from a mixture of fatty alcohols containing C12 to C15 straight-chain alcohols). When Mo DTCs are formed by such amines according to known methods, the result is a Mo DTC according to formula 1 in which R1 does not equal R2. If a single asymmetric amine is the source, then R3 and R4 would be the same as R1 and R2, respectively. However, if the amine source also includes a second asymmetric amine, then it is also possible that at least one of R3 or R4 differs from at least one of R1 and R2. Likewise, an amine source based on a mixture of asymmetric and symmetric amines could give a Mo DTC in which R3 and R4 were the same, but different from at least one of R1 and R2.

The invention also relates to lubricating compositions containing an effective amount of the novel asymmetric molybdenum dithiocarbamates The novel and improved lubricant additives have improved friction reduction properties, better solubility, and allow for a higher molybdenum content afforded by a lower diluent requirement for utility. In particular, the invention relates to novel molybdenum dialkyldithiocarbamates prepared from asymmetric dialkylamines, mixtures of asymmetric dialkylamines or mixtures of asymmetric and symmetric dialkylamines, mixtures of these molybdenum dialkyldithiocarbamates with other molybdenum dialkyldithiocarbamates, lubricating compositions containing said compounds and mixtures; as well as a method for improving the solubility of a MoDTC in a lubricating composition, a method for preparing a MoDTC having improved viscosity, a method for preparing a lubricating composition with increased friction reduction, and a method for preparing a MoDTC having increased molybdenum content.

It has now been discovered that a novel class of molybdenum dialkyldithiocarbamates imparts improved antifriction properties to lubricants, has generally improved solubility in lubricating compositions and has lower additive viscosities. The lower intrinsic viscosities allow the use of less diluent oil providing higher molybdenum-content additives. In addition, the admixture of these novel compounds with other molybdenum dialkyldithiocarbamates enhances the solubility of the other molybdenum dialkyldithiocarbamates. The novel molybdenum dialkyldithiocarbamates are prepared from asymmetric dialkylamines or mixtures of asymmetric dialkylamines according to a method known in the prior art. However, the inventive compounds and resulting lubricating compositions were not possible in view of the prior art, and their surprising improved properties could not have been foreseen.

DETAILED DESCRIPTION OF THE INVENTION

Figure 1:
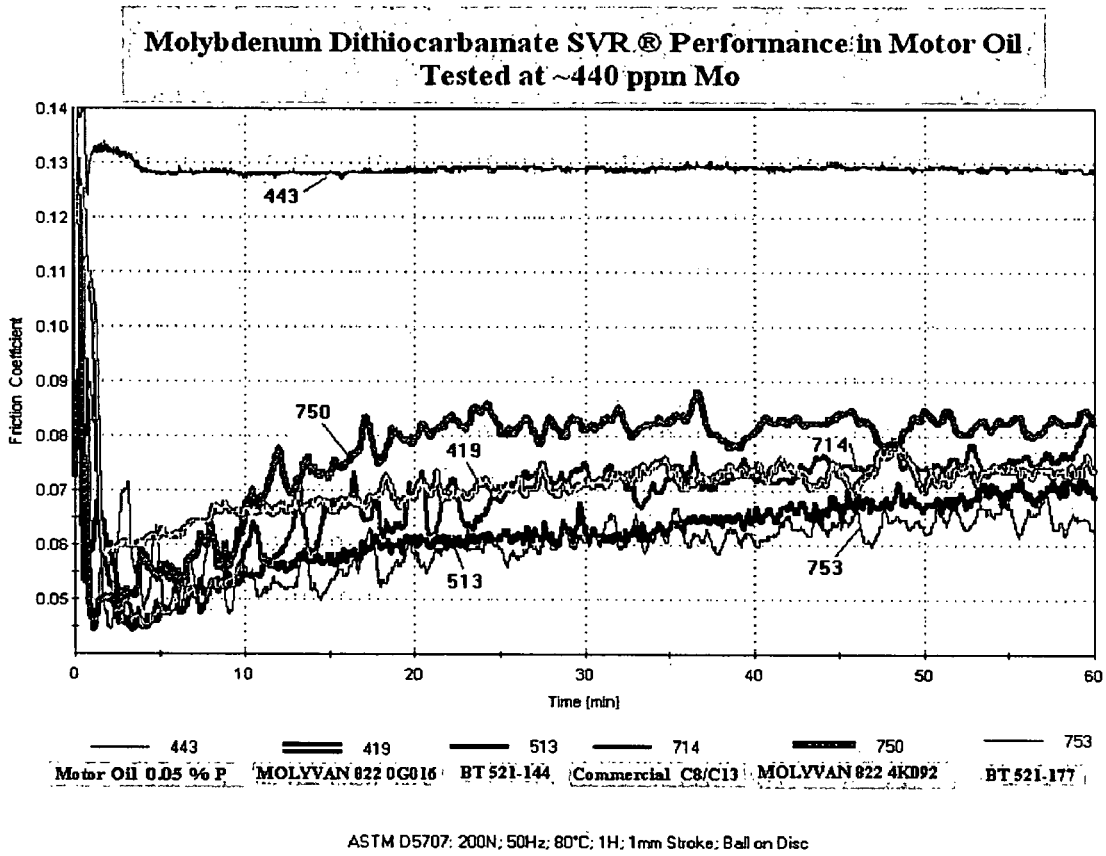
FIG. 1 shows a graph comparing friction properties of the inventive compound compared to prior art compounds.

Molybdenum dithiocarbamates are complexes of an inorganic core with dithiocarbamic acid. Bridged or single molybdenum ("mono-nuclear") cores have been theorized. Additionally, coordination spaces on the molybdenum core may be filled with free amine or other coordinating moieties. This invention relates to the novel compounds formed by utilization of the relatively new asymmetrical dialkyl amine (with different alkyl groups) and the unexpected improvements achieved by this new technology.

The novel molybdenum dialkyldithiocarbamates are prepared by any of a number of methods known to those skilled in the art, such as, but not limited to, the reaction of molybdenum trioxide, water, carbon disulfide and one or more asymmetric dialkylamines HNR1R2, where R1 and R2 are dissimilar. R1 and R2 are independently selected from branched or straight chain groups containing 3 to 19 carbon atoms and preferable C8 to C13 and branched chain to achieve higher solubility effects. Mixtures of asymmetric and symmetric dialkylamines can also be used. This would be expected to form new technology as we have seen that the ligands "scramble". Molybdenum complexes are typically theorized as having 2 dithiocarbamyl ligands. Therefore, the molecule formed by utilization of symmetric and asymmetric dialkyl amine would afford a novel molecule with one of each dithiocarbamyl ligand on the complex. Therefore, the novel invention would be produced in substantial amounts even from small amount of the asymmetrical dialkylamine utilized in the molybdenum dithiocarbamate synthesis.

Applicants have now discovered that Mo DTCs, preferably manufactured from asymmetric dialkylamine starting groups, provide surprisingly superior friction reduction when compared to the prior art compounds. In particular, symmetric Mo DTCs in which R1 is different from R2, and R3 is different from R4, provide superior performance compared to compounds where R1=R2 and R3=R4. In this respect, applicant's compounds are not necessarily asymmetrical, in that R1 and R3 may both be the same and R2 and R4 may be the same, where R1 does not equal R2. It is also contemplated that compounds formed from two different asymmetric diamines would similarly have superior friction properties. Accordingly, the invention comprises molybdenum dialkyl dithiocarbamates formed by at least one asymmetric dialkylamine. The inventive compounds are such that at least R1 does not equal R2; and preferably, further wherein R3 does not equal R4. It is also noted that excellent results are obtained, in particular as to friction reduction, in the absence of an asymmetric Mo DTC as required by Tanaka '725

The groups, which may form R1 through R4, are well known in the art, for example as set forth in the Tanaka patents referenced above. In addition, the groups that may form R1 through R4 may also contain heteroatoms, such as oxygen and sulfur.

The improved antioxidant, antiwear compositions of the invention may be incorporated in the lubricating compositions by known methods in an amount effective to produce the desired oxidation inhibiting characteristics, for example as 0.01 to 15 percent by weight based on the total weight of the lubricating composition. In one embodiment of the invention, the amount may range from about 0.01 to 5.0 percent by weight based on the total weight of the lubricating composition. In another embodiment of the invention, the amount range is about 0.1 to 3.0 percent of the additive based on the total weight of the lubricating composition. The compositions impart metal deactivating as well as oxidation inhibiting properties to natural and synthetic lubricants formulated as oils or greases.

The base oils employed as lubricant vehicles are typical oils used in automotive and industrial applications such as, among others, turbine oils, hydraulic oils, gear oils, crankcase oils and diesel oils. Natural base oils include mineral oils, petroleum oils, paraffinic oils and the vegetable oils. The base oil may also be selected from oils derived from petroleum hydrocarbon and synthetic sources. The hydrocarbon base oil may be selected from naphthenic, aromatic, and paraffinic mineral oils. The synthetic oils may be selected from, among others, ester-type oils (such as silicate esters, pentaerythritol esters and carboxylic acid esters), hydrogenated mineral oils, silicones, silanes, polysiloxanes, alkylene polymers, and polyglycol ethers.

The lubricating compositions optionally contain the necessary ingredients to prepare the composition, as for example dispersing agents, emulsifiers, and viscosity improvers. Greases may be prepared by adding thickeners, as for example salts and complexes of fatty acids, polyurea compounds, clays and quartemary ammonium bentonite. Depending on the intended use of the lubricant, other functional additives may be added to enhance a particular property of the lubricant.

The lubricating compositions may also contain one or more of the following additives:

1. Borated and/or non-borated dispersants
2. Additional antioxidant compounds
3. Seal swell compositions
4. Friction modifiers
5. Extreme pressure/antiwear agents
6. Viscosity modifiers
7. Pour point depressants
8. Detergents
9. Phosphates
10. Antifoamants 11. Rust inhibitors
12. Copper corrosion inhibitors 1. Borated and/or Non-Borated Dispersants Non-borated ashless dispersants may be incorporated within the final fluid composition in an amount comprising up to 10 weight percent on an oil-free basis. Many types of ashless dispersants listed below are known in the art. Borated ashless dispersants may also be included.

(A) "Carboxylic dispersants" are reaction products of carboxylic acylating agents (acids, anhydrides, esters, etc.) containing at least about 34 and preferably at least about 54 carbon atoms reacted with nitrogen-containing compounds (such as amines), organic hydroxy compounds (such aliphatic compounds including monohydric and polyhydric alcohols, or aromatic compounds including phenols and naphthols), and/or basic inorganic materials. These reaction products include imide, amide and ester reaction products of carboxylic acylating agents. Examples of these materials include succinimide dispersants and carboxylic ester dispersants. The carboxylic acylating agents include alkyl succinic acids and anhydrides wherein the alkyl group is a polybutyl moiety, fatty acids, isoaliphatic acids (e.g., 8-methyloctadecanoic acid), dimer acids, addition dicarboxylic acids, addition (4+2 and 2+2) products of an unsaturated fatty acid with an unsaturated carboxylic reagent), trimer acids, addition tricarboxylic acids (e.g., Empol® 1040, Hystrene® 5460 and Unidyme® 60), and hydrocarbyl substituted carboxylic acylating agents (from olefins and/or polyalkenes). In one preferred embodiment, the carboxylic acylating agent is a fatty acid. Fatty acids generally contain from about 8 up to about 30, or from about 12 up to about 24 carbon atoms. Carboxylic acylating agents are taught in U.S. Pat. Nos. 2,444,328, 3,219,666 and 4,234,435, which are incorporated herein by reference. The amine may be a mono- or polyamine. The monoamines generally have at least one hydrocarbyl group containing 1 to about 24 carbon atoms, with from 1 to about 12 carbon atoms. Examples of monoamines include fatty (C8-C30) amines, primary ether amines (SURFAM® amines), tertiary-aliphatic primary amines ("Primene"), hydroxyamines (primary, secondary or tertiary alkanol amines), ether N-(hydroxyhydrocarbyl)amines, and hydroxyhydrocarbyl amines ("Ethomeens" and "Propomeens"). The polyamines include alkoxylated diamines ("Ethoduomeens"), fatty diamines ("Duomeens"), alkylenepolyamines (ethylenepolyamines), hydroxy-containing polyamines, polyoxyalkylene polyamines (such as JEFFAMINES), condensed polyamines (a condensation reaction between at least one hydroxy compound with at least one polyamine reactant containing at least one primary or secondary amino group), and heterocyclic polyamines. Useful amines include those disclosed in U.S. Pat. Nos. 4,234,435 and 5,230,714 that are incorporated herein by reference. Examples of these "carboxylic dispersants" are described in British Patent 1,306,529 and in U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, and Re 26,433, which are incorporated herein by reference for disclosure of dispersants.

(B) "Amine dispersants" are reaction products of relatively high molecular weight aliphatic or alicyclic halides and amines, preferably polyalkylene polyamines. Examples thereof are described, for example, in U.S. Pat. Nos. 3,275,554, 3,438,757, 3,454,555, and 3,565,804, which are incorporated herein by reference for disclosure of dispersants.

(C) "Mannich dispersants" are the reaction products of alkyl phenols in which the alkyl group contains at least about 30 carbon atoms with aldehydes (especially formaldehyde) and amines (especially polyalkylene polyamines). The materials described in U.S. Pat. Nos. 3,036,003, 3,236,770, 3,414,347, 3,448,047, 346,172, 3,539,633, 3,586,629, 3,591,598, 3,634,515, 3,725,480, and 3,726,882 are incorporated herein by reference for disclosure of dispersants.

(D) Post-treated dispersants are obtained by reacting carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds, phosphorus compounds or the like. U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422 are incorporated herein by reference for disclosure of dispersants.

(E) Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymer dispersants are disclosed in U.S. Pat. Nos. 3,329,658, 3,449,250, 3,519,656, 3,666,730, 3,687,849, and 3,702,300, which are incorporated herein by reference for disclosure of dispersants and ashless dispersants. Borated dispersants are described in U.S. Pat. Nos. 3,087,936 and 3,254,025, which are incorporated herein by reference for disclosure of borated dispersants.

Also included, as possible dispersant additives are those disclosed in U.S. Pat. Nos. 5,198,133 and 4,857,214, which are incorporated herein by reference. The dispersants of these patents compare the reaction products of an alkenyl succinimide or succinimide ashless dispersant with a phosphorus ester or with an inorganic phosphorus-containing acid or anhydride and a boron compound.

2. Additional Antioxidant Compounds

Other antioxidant may be used in the compositions of the present invention, if desired. Typical antioxidants include hindered phenolic antioxidants, secondary aromatic amine antioxidants, sulfurized phenolic antioxidants, oil-soluble copper compounds, phosphorus-containing antioxidants, organic sulfides, disulfides and polysulfides and the like.

Illustrative sterically hindered phenolic antioxidants include orthoalkylated phenolic compounds such as 2,6-di-tert-butylphenol, 4-methyl-2,6-di-tert-butylphenol, 2,4,6-tri-tert-butylphenol, 2-tert-butylphenol, 2,6-disopropylphenol, 2-methyl-6-tert-butylphenol, 2,4-dimethyl-6-tert-butylphenol, 4-(N,N-dimethylaminomethyl)-2,8-di-tert-butylphenol, 4-ethyl-2,6-di-tert-butylphenol, 2-methyl-6-styrylphenol, 2,6-distyryl-4-nonylphenol, and their analogs and homologs. Mixtures of two or more such mononuclear phenolic compounds are also suitable.

Other preferred phenol antioxidants for use in the compositions of this invention are methylene-bridged alkylphenols, and these can be used singly or in combinations with each other, or in combinations with sterically hindered un-bridged phenolic compounds. Illustrative methylene-bridged compounds include 4,4'-methylenebis(6-tert-butyl o-cresol), 4,4'-methylenebis(2-tert-amyl-o-cresol), 2,2'-methylenebis(4-methyl-6-tert-butylphenol), 4,4'-methylenebis(2,6-di-tert-butylphenol) and similar compounds. Particularly preferred are mixtures of methylene-bridged alkylphenols such as are described in U.S. Pat. No. 3,211,652, which is incorporated herein by reference. Amine antioxidants, especially oil-soluble aromatic secondary amines may also be used in the compositions of this invention. Although aromatic secondary monoamines are preferred, aromatic secondary polyamines are also suitable. Illustrative aromatic secondary monoamines include diphenylamine, alkyl diphenylamines containing 1 or 2 alkyl substituents each having up to about 16 carbon atoms, phenyl-.beta.-naphthylamine, phenyl-p-naphthylamine, alkyl- or aralkyl-substituted phenyl-.beta.-naphthylamine containing one or two alkyl or aralkyl groups each having up to about 16 carbon atoms, alkyl- or aralkyl-substituted phenyl-p-naphthylamine containing one or two alkyl or aralkyl groups each having up to about 16 carbon atoms, and similar compounds.

A preferred type of aromatic amine antioxidant is an alkylated diphenylamine of the general formula:

$$R_1—C_6H_4—NH—C_6H_4—R_2$$

where $R_1$ is an alkyl group (preferably a branched alkyl group) having 8 to 12 carbon atoms, (more preferably 8 or 9 carbon atoms) and $R_2$ is a hydrogen atom or an alkyl group (preferably a branched alkyl group) having 8 to 12 carbon atoms, (more preferably 8 or 9 carbon atoms). Most preferably, $R_1$ and $R_2$ are the same. One such preferred compound is available commercially as Naugalube® 438L, a material which is understood to be predominately a 4,4'-dinonyldiphenylamine (i.e., bis(4-nonylphenyl)(amine)) in which the nonyl groups are branched.

Another useful type of antioxidant for preferred inclusion in the compositions of the invention are one or more liquid, partially sulfurized phenolic compounds such as are prepared by reacting sulfur monochloride with a liquid mixture of phenols--at least about 50 weight percent of which mixture of phenols is composed of one or more reactive, hindered phenols--in proportions to provide from about 0.3 to about 0.7 gram atoms of sulfur monochloride per mole of reactive, hindered phenol so as to produce a liquid product. Typical phenol mixtures useful in making such liquid product compositions include a mixture containing by weight about 75% of 2,6-di-tert-butylphenol, about 10% of 2-tert-butylphenol, about 13% of 2,4,6-tri-tert-butylphenol, and about 2% of 2,4-di-tert-butylphenol. The reaction is exothermic and thus is preferably kept within the range of about 15.degree. C. to about 70.degree. C., most preferably between about 40.degree. C. to about 60.degree. C.

Another useful type of antioxidant are 2,2,4-trimethyl-1,2-dihydroquinoline (TMDQ) polymers and homologs containing aromatized terminal units such as those described in U.S. Pat. No. 6,235,686, which is hereby incorporated by reference.

Mixtures of different antioxidants may also be used. One suitable mixture is comprised of a combination of: (i) an oil-soluble mixture of at least three different sterically hindered tertiary butylated monohydric phenols, which is in the liquid state at 25.degree. C.; (ii) an oil-soluble mixture of at least three different sterically-hindered, tertiary butylated methylene-bridged polyphenols; and (iii) at least one bis(4-alkylphenyl) amine wherein the alkyl group is a branched alkyl group having 8 to 12 carbon atoms, the proportions of (i), (ii) and (iii) on a weight basis falling in the range of 3.5 to 5.0 parts of component (i) and 0.9 to 1.2 parts of component (ii) per part by weight of component (iii), as disclosed in U.S. Pat. No. 5,328,619, which is incorporated herein by reference.

Other useful preferred antioxidants are those included in the disclosure of U.S. Pat. No. 4,031,023, which is herein incorporated by reference.

3. Seal Swell Compositions

Compositions that are designed to keep seals pliable are also well known in the art. A preferred seal swell composition is isodecyl sulfolane. The seal swell agent is preferably incorporated into the composition at about 0.1-3 weight percent. Substituted 3-alkoxysulfolanes are disclosed in U.S. Pat. No. 4,029,587, which is incorporated herein by reference.

4. Friction Modifiers

Friction modifiers are also well known to those skilled in the art. A useful list of friction modifiers is included in U.S. Pat. No. 4,792,410, which is incorporated herein by reference. U.S. Pat. No. 5,110,488 discloses metal salts of fatty acids and especially zinc salts and is incorporated herein by reference. Useful friction modifiers include fatty phosphites, fatty acid amides, fatty epoxides, borated fatty epoxides, fatty amines, glycerol esters, borated glycerol esters alkoxylated fatty amines, borated alkoxylated fatty amines, metal salts of fatty acids, sulfurized olefins, fatty imidazolines, molybdenum dithiocarbamates (e.g., U.S. Pat. No. 4,259,254, incorporated herein by reference), molybdate esters (e.g., U.S. Pat. Nos. 5,137,647 and 4,889,647, both incorporated herein by reference), molybdate amine with sulfur donors (e.g., U.S. Pat. No. 4,164,473 incorporated herein by reference), and mixtures thereof.

The preferred friction modifier is a borated fatty epoxide as previously mentioned as being included for its boron content. Friction modifiers are preferably included in the compositions in the amounts of 0.1-10 weight percent and may be a single friction modifier or mixtures of two or more.

Friction modifiers also include metal salts of fatty acids. Preferred cations are zinc, magnesium, calcium, and sodium and any other alkali or alkaline earth metals may be used. The salts may be overbased by including an excess of cations per equivalent of amine. The excess cations are then treated with carbon dioxide to form the carbonate.

The metal salts are prepared by reacting a suitable salt with the acid to form the salt, and where appropriate adding carbon dioxide to the reaction mixture to form the carbonate of any cation beyond that needed to form the salt. A preferred friction modifier is zinc oleate.

5. Extreme Pressure/Antiwear Agents

Dialkyl dithiophosphate succinates may be added to provide antiwear protection. Zinc salts are preferably added as zinc salts of phosphorodithioic acids or dithiocarbamic acid. Among the preferred compounds for use are zinc diisooctyl dithiophosphate and zinc dibenzyl dithiophosphate and amyl dithiocarbamic acid. Also included in lubricating compositions in the same weight percent range as the zinc salts to give antiwear/extreme pressure performance are dibutyl hydrogen phosphite (DBPH) and triphenyl monothiophosphate, and the thiocarbamate ester formed by reacting dibutyl amine, carbon disulfide and the methyl ester of acrylic acid. The thiocarbamate is described in U.S. Pat. No. 4,758,362 and the phosphorus-containing metal salts are described in U.S. Pat. No. 4,466,894. Both patents are incorporated herein by reference. Antimony or lead salts may also be used for extreme pressure. The preferred salts are of dithiocarbamic acid such as antimony diamyldithiocarbamate.

6. Viscosity Modifiers

Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers. Examples of commercially available VMs, DVMs and their chemical types are listed below. The DVMs are designated by a (D) after their number. Representative viscosity modifers that are commercially available are listed below in Table 1.

TABLE A

| Viscosity Modifier | Tradename | Commercial Source |
|---|---|---|
| 1. Polyisobutylenes | Indopol ®<br>Parapol ®<br>Polybutylene ®<br>Hyvis ® | Amoco<br>Exxon (Paramins)<br>Chevron<br>British Petroleum |
| 2. Olefin copolymers | Lubrizol ® 7060, 7065, 7067<br>Paratone ® 8900, 8940, 8452, 8512<br>ECA-6911<br>TLA 347, 555(D), 6723(D)<br>Trilene ® CP-40, CP-60 | Lubrizol<br>Exxon<br>Exxon (Paramins)<br>Texaco<br>Uniroyal |
| 3. Hydrogenated styrenediene copolymers | Shellvis ® 50, 40<br>LZ ® 7341, 7351, 7441 | Shell<br>Lubrizol |
| 4. Styrene, maleate copolymers | LZ ® 3702(D), 3715, 3703(D) | Lubrizol |
| 5. Polymethacrylates (PMA) | Acryloid ® 702, 954(D), 985(D), 1019, 1265(D)<br>TLA 388, 407, 5010(D), 5012(D)<br>Viscoplex ® 4-950(D), 6-500(D), 1515 | Rohm GmbH<br>Texaco<br>Rohm GmbH |
| 6. Olefin-graft PMA polymer | Viscoplex ® 2-500, 2-600 | Rohm GmbH |
| 7. Hydrogenated polyisoprene star polymers | Shellvis ® 200, 260 | Shell |

Summaries of viscosity modifiers can be found in U.S. Pat. Nos. 5,157,088, 5,256,752 and 5,395,539, which are incorporated herein by reference. The VMs and/or DVMs preferably are incorporated into the fully formulated compositions at a level of up to 10% by weight.

7. Pour Point Depressants (PPD)

These components are particularly useful to improve low temperature qualities of lubricating oils. A preferred pour point depressant is an alkylnaphthalene. Pour point depressants are disclosed in U.S. Pat. Nos. 4,880,553 and 4,753,745, which are incorporated herein by reference. PPDs are commonly applied to lubricating compositions to reduce viscosity measured at low temperatures and low rates of shear. The pour point depressants are preferably used in the range of 0.1-5 weight percent. Examples of tests used to access low temperature, low shear rate rheology of lubricating fluids include ASTM D97 (pour point), ASTM D2983 (Brookfield viscosity), D4684 (Mini-rotary Viscometer) and D5133 (Scanning Brookfield).

Examples of commercially available pour point depressants and their chemical types are listed in Table 2.

TABLE B

| Pour Point Depressant | Tradename | Source |
|---|---|---|
| Polymethacrylates | Acryloid 154-70, 3003, 3007<br>LZ ® 7749B, 7742, 7748<br>TC 5301, 10314 | Rohm & Haas<br>Lubrizol<br>Texaco |
| Vinyl acetate/fumarate or maleate copolymers | ECA 11039, 9153 | Exxon (Paramins) |
| Styrene, maleate copolymers | LZ ® 662 | Lubrizol |

8. Detergents

Lubricating compositions in many cases also preferably include detergents. Detergents as used herein are preferably metal salts of organic acids. The organic acid portion of the detergent is preferably a sulphonate, carboxylate, phenate, or salicylate. The metal portion of the detergent is preferably an alkali or alkaline earth metal. Preferred metals are sodium, calcium, potassium and magnesium. Preferably, the detergents are overbased, meaning that there is a stoichiometric excess of metal over that needed to form the neutral metal salt.

Preferred overbased organic salts are the sulfonate salts having a substantially oleophilic character and which are formed from organic materials. Organic sulfonates are well known materials in the lubricant and detergent arts. The sulfonate compound should preferably contain on average from about 10 to about 40 carbon atoms, more preferably from about 12 to about 36 carbon atoms and most preferably from about 14 to about 32 carton atoms on average. Similarly, the phenates, oxylates and carboxylates preferably have a substantially oleophilic character.

While the present invention allows for the carbon atoms to be either aromatic or in paraffinic configuration, it is highly preferred that alkylated aromatics be employed. While naphthalene based materials may be employed, the aromatic of choice is the benzene moiety.

The one particularly preferred component is thus an overbased monosulfonated alkylated benzene, and is preferably the monoalkylated benzene. Preferably, alkyl benzene fractions are obtained from still bottom sources and are mono- or di-alkylated compounds. It is believed, in the present invention, that the mono-alkylated aromatics are superior to the dialkylated aromatics in overall properties.

It is preferred that a mixture of mono-alkylated aromatics (benzene) be utilized to obtain the mono-alkylated salt (benzene sulfonate) in the present invention. The mixtures wherein a substantial portion of the composition contains polymers of propylene as the source of the alkyl groups assist in the solubility of the salt. The use of monofunctional (e.g., mono-sulfonated) materials avoids crosslinking of the molecules with less precipitation of the salt from the lubricant. It is preferred that the salt be overbased. The excess metal from overbasing has the effect of neutralizing acids, which may build up in the lubricant. A second advantage is that the overbased salt increases the dynamic coefficient of friction. Preferably, the excess metal will be present over that which is required to neutralize the acids at about in the ratio of up to about 30:1, preferably 5:1 to 18:1 on an equivalent basis.

The amount of the overbased salt utilized in the composition is preferably from about 0.1 to about 10 weight percents on an oil free basis. The overbased salt is usually made up in about 50% oil with a TBN range of 10-600 on an oil free basis. Borated and non-borated overbased detergents are described in U.S. Pat. Nos. 5,403,501 and 4,792,410, which are herein incorporated by reference for disclosure pertinent hereto.

9. Phosphates

The lubricating compositions can also preferably include at least one phosphorus acid, phosphorus acid salt, phosphorus acid ester or derivative thereof including sulfur-containing analogs preferably in the amount of 0.002-1.0 weight percent. The phosphorus acids, salts, esters or derivatives thereof include compounds selected from phosphorus acid esters or salts thereof, phosphites, phosphorus-containing amides, phosphorus-containing carboxylic acids or esters, phosphorus containing ethers and mixtures thereof In one embodiment, the phosphorus acid, ester or derivative can be a phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids.

One class of compounds are adducts of O,O-dialkyl-phosphorodithioates and esters of maleic or fumaric acid. The compounds can be prepared by known methods as described in U.S. Pat. No. 3,359,203, as for example O,O-di(2-ethylhexyl) S-(1,2-dicarbobutoxyethyl)phosphorodithioate.

The dithiophosphoric acid esters of carboxylic acid esters are another class of compounds useful to the invention. Preferred are alkyl esters having 2 to 8 carbon atoms, as for example 3-[[bis(1-methylethoxy)phosphinothioyl]thio] propionic acid ethyl ester.

A third class of ashless dithiophosphates for use with the present invention includes:

(i) those of the formula

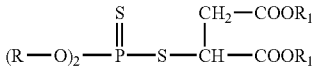

wherein R and $R_1$ are independently selected from alkyl groups having 3 to 8 carbon atoms (commercially available as VANLUBE 761 1M, from R. T. Vanderbilt Co., Inc.);

(ii) dithiophosphoric acid esters of carboxylic acid such as those commercially available as IRGALUBE® 63 from Ciba Geigy Corp.;

(iii) triphenylphosphorothionates such as those commercially available as IRGALUBE® TPPT from Ciba Geigy Corp.; and (iv) methylene bis(dialkyldithiocarbamates) wherein the alkyl group contains 4 to 8 carbon atoms. For example, methylenebis(dibutyldithiocarbamate) is commercially available as VANLUBE 7723® from R. T. Vanderbilt Co., Inc).

Zinc salts are preferably added to lubricating compositions in amounts of 0. 1-5 triphenylphosphorothionates wherein the phenyl group may be substituted by up to two alkyl groups. An example of this group, among others, is triphenyl-phosphorothionate available commercially as IRGALUBE® TPPT (manufactured by Ciba-Geigy Corp.).

A preferred group of phosphorus compounds are dialkyphosphoric acid mono alkyl primary amine salts, such as those described in U.S. Pat. No. 5,354,484, which is herein incorporated by reference. Eighty-five percent phosphoric acid is the preferred compound for addition to the fully formulated ATF package and is preferably included at a level of about 0.01-0.3 weight percent based on the weight of the ATF.

The amine salts of alkyl phosphates are prepared by known methods, e.g., a method disclosed in U.S. Pat. No. 4,130,494, incorporated herein by reference. A suitable mono- or diester of phosphoric acid or their mixtures is neutralized with an amine. When monoester is used, two moles of the amine will be required, while the diester will require one mole of the amine. In any case, the amount of amine required can be controlled by monitoring the neutral point of the reaction where the total acid number is essentially equal to the total base number. Alternately, a neutralizing agent such as ammonia or ethylenediamine can be added to the reaction.

The preferred phosphate esters are aliphatic esters, among others, 2-ethylhexyl, n-octyl, and hexyl mono- or diesters. The amines can be selected from primary or secondary amines. Particularly preferred are tert-alkyl amines having 10 to 24 carbon atoms. These amines are commercially available as, for example, Primene® 81 R manufactured by Rohm and Haas Co.

The sulfonic acid salts are well known in the art and are available commercially. Representative of the aromatic sulfonic acids that can be used in preparing the synergists of the invention are alkylated benzenesulfonic acids and alkylated naphthalenesulfonic acids having 1 to 4 alkyl groups of 8 to 20 carbons each. Particularly preferred are naphthalenesulfonates substituted by alkyl groups having 9 to 18 carbons each, as for example dinonylnaphthalenesulfonate.

10. Antifoamants

Antifoaming agents are well known in the art as silicone or fluorosilicone compositions. Such antifoam agents are available from Dow Corning Chemical Corporation and Union Carbide Corporation. A preferred fluorosilicone antifoam product is Dow FS-1265. Preferred silicone antifoam products are Dow Corning DC-200 and Union Carbide UC-L45. Other antifoam agents which may be included in the composition either alone or in admixture is a polyacrylate antifoamer available from Monsanto Polymer Products Co. of Nitro, West Virginia known as PC-1244. Also, a siloxane polyether copolymer antifoamer available from OSI Specialties, Inc. of Farmington Hills, Mich. may also be included. One such material is sold as SILWET-L-7220. The antifoam products are preferably included in the compositions of this invention at a level of 5 to 80 parts per million with the active ingredient being on an oil-free basis.

11. Rust Inhibitors

Embodiments of rust inhibitors include metal salts of alkylnapthalenesulfonic acids.

12. Copper Corrosion Inhibitors

Embodiments of copper corrosion inhibitors that may optionally be added include thiazoles, triazoles and thiadiazoles. Example embodiments of such compounds include benzotriazole, tolyltriazole, octyltriazole, decyltriazole, dodecyltriazole, 2-mercapto-benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis (hydrocarbyldithio)-1,3,4-thiadiazoles.

The following examples are given for the purpose of illustrating the invention and are not intended to limit the invention. All percentages and parts are based on weight unless otherwise indicated.

EXAMPLES

Example 1

Water (23.5 g.), (2-ethylhexyl)tridecylamine (70.7 g., 0.226 mole) and Ergon Hygold oil (8.8 g.) are added to a 500-ml, round-bottom flask. The mixture is cooled to about 20 degrees C. and with good agitation molybdenum trioxide (16.2 g., 0.113 mole) is then added. Using a cooling bath, carbon disulfide (18.0 g., 0.237 mole) is added at such a rate that the reaction temperature does not exceed 45 degrees C. After all the carbon disulfide has been added, the mixture is agitated at 55-60 degrees C. for 30 minutes and then heated to reflux for 4.5 hours. The condenser is then set for distillation and the mixture heated to distill off most of the water. Full vacuum is then slowly applied and the temperature is maintained at 125-130 degrees C. for 2.5-3 hours. The vacuum is released and Ergon Hygold 100 oil (100 g.) is added. The product is then suction filtered at about 80 degrees C. giving a clear, dark-brown liquid (BT-521-144).

Example 2

Water (23.5 g.), isodecyloxypropyl-isopropylamine (available from Tomah[3] Products as SA-14,3 ether amine) (55.3 g., ~0.23 mole) and Uninap 100 SD oil (8.8 g.) are added to a 500-ml, round-bottom flask. The mixture is cooled to about 20 degrees C. and with good agitation molybdenum trioxide (16.2 g., 0.113 mole) is then added. Using a cooling bath, carbon disulfide (18.0 g., 0.237 mole) is added at such a rate that the reaction temperature does not exceed 30 degrees C. After all the carbon disulfide has been added, the mixture is heated to reflux for about 6.5 hours. The condenser is then set for distillation and the mixture heated to distill off most of the water. Full vacuum is slowly applied and the temperature is maintained at 125-130 degrees C. for 30 minutes. The vacuum is released, more Uninap 100 SD oil (41.2 g.) is added and the product is suction filtered while still hot giving a clear, dark red-amber liquid (BT-521-167).

Example 3

Water (23.5 g.), alkyloxypropyl-isopropylamine (alkyl=C12 to C15) (available from Tomah[3] Products as SA-19,3 ether amine) (80.0 g., 0.23 mole) and Uninap 100 SD oil (8.8 g.) are added to a 500-ml, round-bottom flask. The mixture is cooled to about 25 degrees C. and with good agitation molybdenum trioxide (16.2 g., 0.113 mole) is then added. Using a cooling bath, carbon disulfide (18.0 g., 0.237 mole) is added at such a rate that the reaction temperature does not exceed 40 degrees C. After all the carbon disulfide has been added, the mixture is heated to reflux for about 3.5 hours. The condenser is then set for distillation and the mixture heated to distill off most of the water. Full vacuum is slowly applied and the temperature is maintained at 125-130 degrees C. for 30 minutes. The vacuum is released and the product is suction filtered while still hot giving a clear, dark red-amber liquid (BT-521-177).

Example 4

Solubility Experiments

The invention also relates to lubricating compositions containing the invention molybdenum dialkyldithiocarbamates and the improved solubility of the inventive compounds in lubricating compositions. The data in Table 1 show that the inventive compounds have much better solubility than the symmetrical-amine molybdenum DTC MOLYVAN® 822 in Infineum oil at −10° C., remaining in solution for the entire 90-day test period.

TABLE 1

LOW TEMPERATURE SOLUBILITY TEST OF INVENTIVE MOLYBDENUM DIALKYLDITHIOCARBAMATES AT 0.9 WEIGHT PERCENT IN INFINEUM ® MOTOR OIL

| Molybdenum Dithiocarbamate | Days at −10° C. in Infineum Motor Oil Without Haze Formation |
|---|---|
| MOLYVAN ® 822 | 1 |
| BT-521-144 | 90* |
| BT-521-177 | 90* |

*End of test period

The data in Table 2 show that when relatively minor amounts of the invention compound, such as 15 weight percent, are mixed with molybdenum dialkyldithiocarbamates prepared from symmetrical dialkylamines, such as MOLYVAN 822, the low temperature solubility of the symmetrical dialkylamine-based MoDTC in lubricating compositions is clearly improved. A dramatic improvement is seen at 20% or more of the invention compound.

TABLE 2

LOW TEMPERATURE SOLUBILITY TEST OF MIXED MOLYBDENUM DIALKYLDITHIOCARBAMATES AT 0.9 WEIGHT PERCENT IN INFINEUM MOTOR OIL

| Weight Percent of BT-521-144 in Infineum ® Motor Oil | Weight Percent of MOLYVAN ® 822 in Infineum ® Motor Oil | Days at −10° C. in Infineum ® Motor Oil Without Haze Formation |
|---|---|---|
| 10 | 90 | 1 |
| 15 | 85 | 34 |
| 20 | 80 | 97* |
| 25 | 75 | 97* |
| 50 | 50 | 97* |

*End of test period

Example 5

SRV Friction Coefficient Data

The test procedure for frictional properties used in this example is derived from the Annual Book of ASTM Standards 2004 section 5 Petroleum Products, Lubricants, and Fossil Fuels volume 05.03 under ASTM method D 5707, "Measuring Friction and Wear Properties of Lubricating Grease using a High-Frequency, Linear-Oscillation (SRV) Test Machine". This test is described in this method under the summary of the test method as "This test method is performed on an SRV test machine using a test ball oscillated under constant load against a test disk." This testing was not modified from the original test description other than the time was reduced from 2 hours to one hour. In the "scope" of this procedure, it is stated that "this test method can also be used for determining a fluid lubricant's ability to protect against wear and coefficient of friction under similar test conditions." The test conditions are recorded on the graph below. Reducing the coefficient of friction of the base oil by additive formulation is a desired goal in lubricant formulation. Molybdenum dithiocarbamates are known to accomplish this but it is desirable to reduce this friction even further. The graph below demonstrates a further improvement of the subject invention. The compound described as 'commercial C8/C 13' is an asymmetric molybdenum dialkyl dithiocarbamate prepared according to the Tanaka patents from two symmetric amines. The results are set out graphically in FIG. 1.

The data in FIG. 1, which is summarized in Table 3, show that the invention molybdenum dithiocarbamates, BT-521-144 and BT-521-177, provide greater friction reduction than commercial C8/C 13 MoDTC and two typical lots of MOLYVAN® 822 (molybdenum dithiocarbamate sold by the R. T. Vanderbilt Company.) Thus the invention compounds improve frictional performance of molybdenum dithiocarbamates achieving lower friction coefficients over the prior art.

TABLE 3

SRV ® FINAL FRICTION COEFFICIENTS FOR MOLYBDENUM DITHIOCARBAMATES IN MOTOR OIL

| MoDTC (~440 ppm Mo) | Final Friction Coefficient |
|---|---|
| Commercial C8/C13 | 0.084 |
| MOLYVAN 822 (4K092) | 0.082 |
| MOLYVAN 822 (0G016) | 0.073 |
| BT-521-144 | 0.068 |
| BT-521-177 | 0.063 |

Example 6

Lower Viscosity of Inventive Molybdenum Dithiocarbamates

The inventive compounds surprisingly show significantly lower viscosities than molybdenum dithiocarbamate prepared from symmetrical amine, e.g. MOLYVAN 822, at the same molybdenum concentrations, thus affording easier handling of the additive (an additional improvement over prior art). The compounds of Examples 1, 2 and 3 were each prepared at three different molybdenum concentrations by varying the amount of diluent oil added. The viscosities were determined and plotted versus the molybdenum concentration in FIG. 2, which clearly shows that the viscosity versus molybdenum content curve rises much more sharply for the C13/C13 MOLYVAN 822 than for the inventive BT-521-144, BT-521-167 and BT-521-177 compounds.

Figure 2:
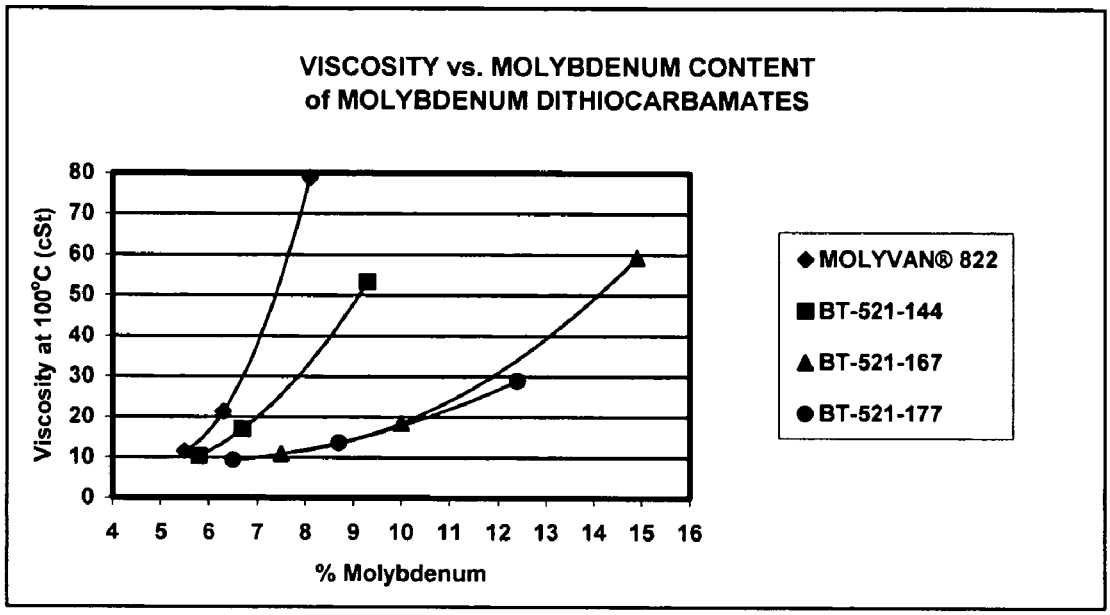
FIG. 2 shows a graph comparing viscosity properties of the inventive compound compared to prior art compounds.

As seen in FIG. 2, the invention compounds BT-521-167 and BT-521-177 prepared from ether amines have dramatically lower viscosities than MOLYVAN 822, providing easily poured compositions with molybdenum concentrations from over 12 weight percent to almost 15 weight percent of molybdenum. The use of less diluent oil in MOLYVAN 822 will only allow about 7.5 weight percent of molybdenum before the composition becomes too viscous to be easily poured.

What is claimed is:

1. An additive for lubricating oil compositions, comprising the reaction product of: at least one asymmetrical dialkylamine of the formula R1-NH—R2 where R1 is isopropyl, and R2 is chosen from the group consisting of (a) isodecyloxypropyl and (b) alkyloxypropyl, where alkyl is one or more of $C_{12}$ to $C_{15}$, carbon disulfide, and a molybdenum source.

2. A molybdenum dithiocarbamate composition according to the following formula, wherein R1 and R3 are isopropyl and R2 and R4 are identical and chosen from the group consisting of (a) isodecyloxypropyl and (b) alkyloxypropyl, where alkyl is one or more of $C_{12}$ to $C_{15}$.

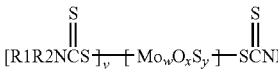

v = 1-2; w = 1-2; x + y = 2-5; z = 1-2

3. A lubricating composition, comprising a base oil and about 0.1-3% by weight of a molybdenum dithiocarbamate composition according to claim 2.

4. A lubricating composition, comprising a base oil, and combination of molybdenum dithiocarbamates being about 0.1-3% by weight of the lubricating composition, the combination comprising:

a first molybdenum dithiocarbamate according to the following formula, wherein in the first molybdenum dithiocarbamate, R1 and R3 are 2-ethylhexyl, and R2 and R4 are tridecyl, and a second molybdenum dithiocarbamate composition according to the following formula, wherein R1, R2, R3and R4 are the same and are selected from alkyl groups C3 to C19:

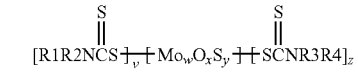

v = 1-2;
w = 1-2;
x + y = 2-5;
z = 1-2 an amount of the first molybdenum dithiocarbamate being at least about 15% by weight of the total weight of the combination of molybdenum dithiocarbamates.

5. The lubricating composition of claim 4, wherein the amount of the first molybdenum dithiocarbamate is at least about 20% by weight of the total weight of the combination of molybdenum dithiocarbamates.

6. A method for preparing a molybdenum dithiocarbamate having improved viscosity and/or friction reduction, comprising reacting:

at least one asymmetrical dialkylamine of the formula R1-NH—R2, where R1 is isopropyl and R2 is chosen from the group consisting of (a) isodecyloxypropyl and (b) alkyloxypropyl, where alkyl is one or more of $C_{12}$ to $C_{15}$, carbon disulfide, and a molybdenum source.

7. An additive composition comprising a combination of molybdenum dithiocarbamates, the combination comprising:

a first molybdenum dithiocarbamate according to the following formula, wherein in the first molybdenum dithiocarbamate, R1 and R3 are 2-ethylhexyl, and R2 and R4 are tridecyl, and a second molybdenum dithiocarbamate composition according to the following formula, wherein R1, R2, R3 and R4 are the same and are selected from alkyl groups C3 to C19:

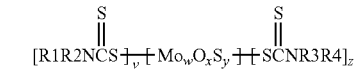

v = 1-2;
w = 1-2;
x + y = 2-5;
z = 1-2 an amount of the first molybdenum dithiocarbamate being at least about 15% by weight of the total weight of the combination of molybdenum dithiocarbamates.

8. The additive composition of claim 7, wherein the amount of the first molybdenum dithiocarbamate is at least about 20% by weight of the total weight of the first and second molybdenum dithiocarbamates.

* * * * *